United States Patent [19]

Foshee et al.

[11] Patent Number: 4,843,852

[45] Date of Patent: Jul. 4, 1989

[54] DISPOSABLE CONSTRUCTION CORE

[75] Inventors: William R. Foshee, Noblesville; Duane B. Nixon; Ralph P. Palmer, both of Indianapolis, all of Ind.

[73] Assignee: Best Lock Corporation, Indianapolis, Ind.

[21] Appl. No.: 203,947

[22] Filed: Jun. 8, 1988

[51] Int. Cl.[4] ..... E05B 33/00

[52] U.S. Cl. ..... 70/367; 70/371; 70/372; 70/375

[58] Field of Search ..... 70/367–375, 70/382, 385, 438, DIG. 13

[56] References Cited

U.S. PATENT DOCUMENTS

| | | | |
|---|---|---|---|
| 1,474,495 | 11/1923 | Segal | 70/370 |
| 1,482,189 | 1/1924 | Heyer | 70/375 |
| 1,575,092 | 3/1926 | Best | 70/373 |
| 1,866,342 | 7/1932 | Best | 70/375 |
| 3,209,568 | 10/1965 | Patriquin | 70/373 |
| 3,429,154 | 2/1969 | Schwartz | 70/375 |
| 3,715,899 | 2/1973 | McCullum | 70/369 |
| 4,098,103 | 7/1978 | Raskevicius | 70/375 X |
| 4,143,531 | 3/1979 | Floyd | 70/367 |
| 4,179,908 | 12/1979 | Schaumburg | 70/360 X |
| 4,444,034 | 4/1984 | Best et al. | 70/369 |
| 4,620,430 | 11/1986 | Latone | 70/375 X |
| 4,761,978 | 8/1988 | Walla | 70/375 X |

FOREIGN PATENT DOCUMENTS

| | | | |
|---|---|---|---|
| 2060762 | 5/1981 | United Kingdom | 70/370 |

*Primary Examiner*—Lloyd A. Gall

*Attorney, Agent, or Firm*—Barnes & Thornburg

[57] ABSTRACT

A core assembly is provided for use in a lock cylinder formed to include an axially extending core-receiving chamber of figure-8 cross-section providing upper and lower chamber portions. A throw member extending into the lower chamber portion is provided for actuating a lock assembly. The core assembly includes a plug member configured to fit in the upper chamber portion, and an actuator member configured to rotate freely in the lower chamber portion. The actuator member includes means for operably engaging the actuating means so that the lock assembly is actuable upon rotation of the actuator member in the lower chamber portion and an assembly for ejecting the plug member from the upper chamber portion in response to withdrawal of the actuator member from the lower chamber portion.

17 Claims, 1 Drawing Sheet

DISPOSABLE CONSTRUCTION CORE

DISPOSABLE CONSTRUCTION CORE

The present invention relates to lock cylinder assemblies, and particularly to a disposable core for operating lock cylinder assemblies mounted in certain doors of a building under construction in place of a conventional permanent key-removable lock core.

At a building construction site, many of the doors will be equipped at some phase of the construction with a lock cylinder designed ultimately to receive a key-removable core for operating the door lockset. However, during the period of construction, it is generally necessary to provide key-operated lock cores only at perimeter doors and a few selected other doors to protect the security of the premises adequately. The locksets of all other non-critical, interior doors could be operated using any suitable non-secure means during the period that the building is under construction instead of using key-operated cores.

It is known to provide a core that is insertable into a conventional door-mounted lock cylinder and manually actuable to operate a lockset and disposable to make way for a permanent keyed lock core after construction. Use of a disposable core during construction advantageously minimizes paperwork problems and costs associated with accounting for keyed lock cores and keys used by workers to operate the keyed lock cores during construction and also with changing cores and combinations after construction. Additional background information and an example of a disposable core for a lock cylinder are disclosed in U.S. Pat. No. 4,143,531 to Floyd. Notwithstanding the foregoing advantages, disposable construction cores are not in widespread use, in part, because of contractor dissatisfaction resulting from difficulties encountered in removing these known disposable cores from lock cylinders and user dissatisfaction resulting from "loose feel" of such disposable cores in operation.

One object of the present invention is to provide a disposable core in which all components comprising the core are easily removed from the core-receiving chamber of the lock cylinder in one swift motion without the use of tools at or prior to the time a permanent key-operated core is to be installed in the lock cylinder.

Another object of the present invention is to provide a disposable core having an actuator member which rotates to actuate a lockset connected to the lock cylinder housing the core and exhibits a slight, but steady, resistance to rotation during operation to convey a characteristic tactile feel of the disposable core to the user during manual rotation of the actuator member.

Yet another object of the present invention is to provide a two-piece disposable core in which the first piece is configured to actuate a lockset connected to a lock cylinder housing the core and the second piece is configured to engage and retain the first piece in its operative position within the lock cylinder.

Still another object of the present invention is to provide a disposable core configured to provide means for orienting a throw member connected to a cam for actuating a lockset in a predetermined alignment position relative to the lock cylinder, which alignment position corresponds to a preferred predetermined position of the cam so that the cam is oriented properly to actuate the lockset.

In accordance with the present invention, a core assembly is provided for use in a lock cylinder formed to include an axially extending core-receiving chamber. The chamber is of figure-8 cross-section and provides upper and lower chamber portions. Means extends into the lower chamber portion for actuating a lock assembly connected to the lock cylinder.

The core assembly includes a plug member configured to fit in the upper chamber portion, and an actuator member configured to rotate freely in the lower chamber portion. The actuator member includes means for operably engaging the actuating means so that the lock assembly is actuable upon rotation of the actuator member in the lower chamber portion and means for ejecting the plug member from the upper chamber portion in response to withdrawal of the actuator member from the lower chamber portion. This feature advantageously causes the plug member to be removed from the core-receiving chamber automatically at the same time the actuator is removed, thereby eliminating the need to undertake a second step using selected tools to remove the plug member.

In preferred embodiments, the plug member includes at least one finger configured to extend into the lower chamber portion while the plug member is positioned in the upper chamber portion. Each finger includes an axially rearwardly presented face. The ejecting means includes means for contacting the at least one finger during withdrawal of the actuator member from the lower chamber portion. The contacting means includes an axially forwardly presented face aligned in confronting relation to the axially rearwardly presented face of its companion finger to intercept the axially rearwardly presented face and apply a movement-inducing force to the plug member during withdrawal of the actuator member from the lower chamber portion.

The lock cylinder includes an inner wall defining the upper chamber portion. The plug member includes a body portion configured to mate with the inner wall and an axially extending prong for resiliently supporting each finger for flexible movement relative to the body portion in a predetermined position biased against the actuator member. Each prong and finger cooperate to apply radially inwardly directed force of a predetermined magnitude to the actuator member to inhibit free rotation of the actuator member relative to the lock cylinder during operation of the actuating means by a user. This force advantageously acts to provide a characteristic tactile feel of the actuator member apparent to and appreciated by the user during manual rotation of the actuator member.

The actuator member includes an elongated shaft having the engaging means at its inner ends, a handle for applying a rotation-inducing torque to the shaft about its longitudinal axis at its outer ends, and an annular, circumferentially extending rim for supporting each finger in its biased position. The rim means is situated on the elongated shaft between the engaging means and the handle.

The rim and the engaging means cooperate to define finger-releasing grooves for receiving each finger upon movement of the shaft to a predetermined axial position in the lower chamber portion during withdrawal of the actuator member. In this special position, the radially inwardly directed force normally applied by each prong and finger set to the actuator member is substantially eliminated to permit free rotation of the actuator member relative to the cylinder. The engaging means includes an axially forwardly presented face arranged to define an axially rearward boundary of the finger-releasing groove and to intercept the finger and apply a movement-inducing force to the plug member during withdrawal of the actuation member from the lower chamber portion. This feature advantageously permits removal of the entire disposable core from the core-receiving chamber of the lock cylinder in one swift motion without using any special tools.

The engaging means includes an actuation cam situated outside of the lock cylinder for operating a lockset and throw members extending into the lower chamber portion to interconnect the actuator member and the actuation cam. The annular, circumferentially extending rim provided in the middle of the elongated shaft is formed to include radially outwardly opening notches for receiving one finger in its biased position during rotation of the actuator member to align the actuation cam and the actuator member in a predetermined arrangement. Such alignment acts to provide an indication of the relative orientation of the actuation cam and the lock cylinder based upon the aligned position of the actuator member. This feature advantageously permits a user to orient the actuation cam properly with respect to the lock cylinder to actuate the lockset simply by rotating the actuator member until the finger snaps into the notch formed in the annular rim of the actuator member.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE INVENTION

Figure 1:
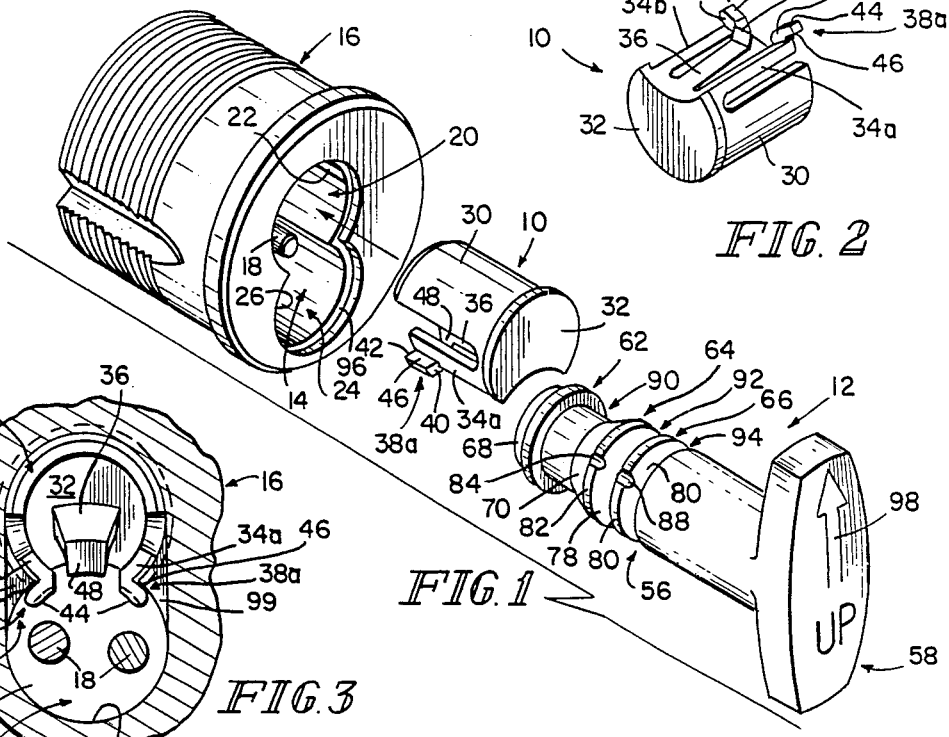
FIG. 1 is an exploded perspective view of a disposable core according to the present invention comprising a plug member and an actuator member ready for insertion into a figure-8-shaped core-receiving chamber in a lock cylinder.

A plug member 10 and an actuator member 12 cooperate to provide a disposable construction core which is installable in a core-receiving chamber 14 of figure-8 cross-section formed in a lock cylinder 16. Normally, chamber 14 provides a home for a conventional key-removable lock core (not shown) which is used to rotate throw pins 18 extending into chamber 14 to actuate a lockset (not shown) in the customary way.

Core-receiving chamber 14 provides an upper chamber portion 20 defined by a first inner wall 22 of cylinder 16 and a lower chamber portion 24 defined by a second inner wall 26 of cylinder 16. Plug member 10 is configured to fit in upper chamber portion 20 in lieu of an upper lobe (not shown) of a conventional key-removable lock core while actuator member 12 is configured to fit in lower chamber portion 24 in lieu of a lower lobe (not shown) of the conventional core.

Figure 2:
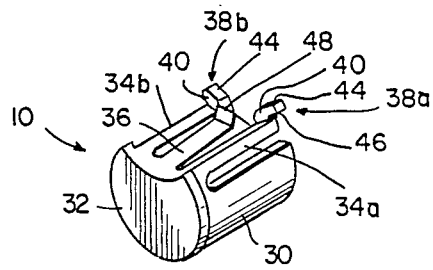
FIG. 2 is a perspective view of the plug member shown in FIG. 1 in an inverted position illustrating a preferred orientation of the fingers and a center tang.
Figure 5:
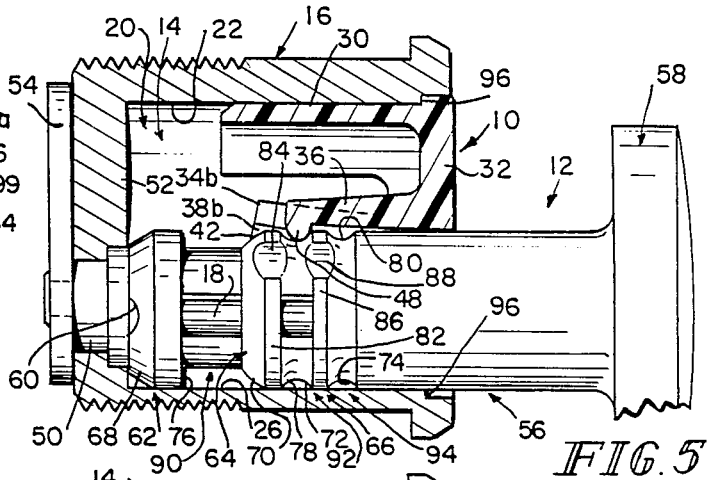
FIG. 5 is a longitudinal sectional view taken along lines 5—5 of FIG. 4, with portions broken away, showing biased engagement of one finger on an annular rim of the actuator member and engagement of the center tang in an annular retaining groove in the actuator member.

A preferred configuration of plug member 10 is shown best in FIGS. 1 and 2. Plug member 10 includes a body portion 30 configured to mate with the first inner wall 22 of cylinder 16 and a closure portion 32 affixed to the body portion 30 to cover a forwardmost opening of upper chamber portion 20 when the plug member 10 is installed in upper chamber portion 20 as shown in FIG. 5. Plug member 10 also includes a pair of axially extending spaced-apart outside prongs 34*a, b* and an axially extending center prong 36 situated between the outside prongs 34*a, b* as shown in FIG. 2. Plug member 10 exhibits a resilient character to permit flexure of outside prongs 34*a, b* and center prong 36 relative to body and closure portions 30 and 32 and is desirably made of an acetal copolymer such as Celanese CELCON M90.

Each of outside prongs 34*a, b* has a proximal end affixed to the closure portion 32 and is provided with a depending finger at its distal end as shown in FIGS. 1 and 2. For example, finger 38*a* is appended to the distal end of outside prong 34*a* and extends away from core body 30 in offset relation to the outside prong to provide an axially forwardly presented front face 40, an axially rearwardly presented back face 42, a radially outwardly presented bottom face 44, and a radially inwardly presented top face 46. Likewise, finger 38*b* is appended to outside prong 34*b* and has a shape complementary to the shape of finger 38*a* so that the core body 30 includes a pair of depending fingers 38*a, b* which extend downwardly into the lower chamber portion 24 when the core body 30 is mounted in the upper chamber portion as shown in FIG. 3.

Figure 3:
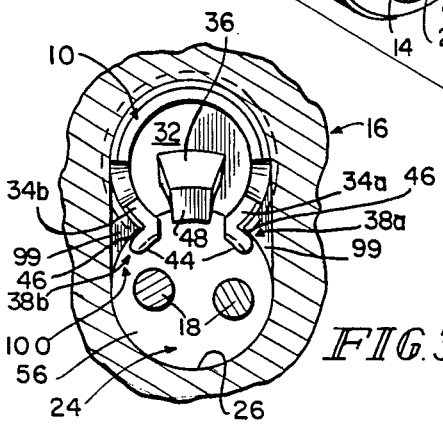
FIG. 3 is a transverse section of a portion of the disposable core and lock cylinder shown in FIG. 1 illustrating a relaxed position of the fingers after insertion of the plug member into the upper chamber portion of the core-receiving chamber.
Figure 6:
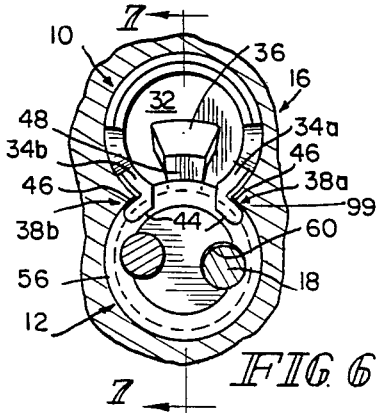
FIG. 6 is a transverse section similar to FIGS. 3 and 4 illustrating a released position of the resilient fingers after withdrawal of the actuator member to a predetermined axial position within the lower chamber portion.

Fingers 38*a, b* are also oriented to extend radially outwardly in opposite directions so that the top faces 46 of the slightly offset fingers 38*a, b* mate with separate portions of the second inner wall 26 to permit sliding engagement of top faces 46 and inner wall 26 during insertion of plug member 10 into the upper chamber portion 20 and subsequent removal therefrom as shown best in FIGS. 3 and 6. Fingers 38*a, b* function to aid in ejecting the plug member 10 from the upper chamber portion 20 in response to retraction of the actuator member 12 as explained below in connection with the discussion of FIGS. 5 and 6. At the same time, fingers 38*a, b* act to apply a yieldable biasing force to the actuator member 12 to provide a characteristic "tactile-feel"

of the actuator member 12 which is apparent to a user during rotation of the actuator member 12 to operate a lockset (not shown).

Center prong 36 has a proximal end affixed to the closure portion 32 and extends in an axially rearward direction in spaced-apart parallel relation to the prongs 34*a, b* in a location between outside prongs 34*a, b* as seen in FIG. 2. A center tang 48 depends from the distal end of center prong 36 as shown best in FIGS. 1, 5, and 7. Center tang 48 functions to limit inadvertent withdrawal of the actuator member 12 from the lower chamber portion 24 in the manner described below.

Figure 7:
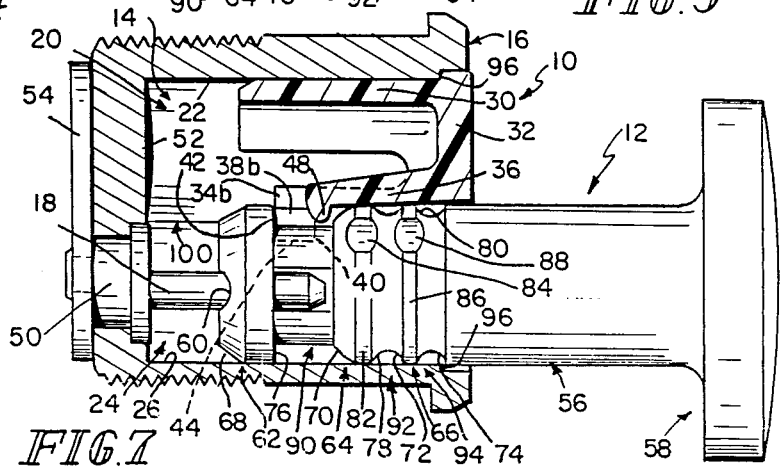
FIG. 7 is a longitudinal sectional view taken along lines 7—7 of FIG. 6, with portions broken away, showing positioning of the one finger and the center tang in the finger-releasing groove in the actuator member.

A throw member 50 is rotatably mounted in an aperture formed in the rear wall 52 of lock cylinder 16 in the customary way as shown in FIGS. 5 and 7. The throw pins 18 are affixed to throw member 50 and extend into the lower chamber portion 24. A cam 54 is coupled to an exposed portion of throw member 50 to rotate therewith and to lie outside of lock cylinder 16 in a position adjacent rear wall 52. Cam 54 is rotatable from an upright inactive position (see FIGS. 5 and 7) to a pivoted lockset-actuating position (not shown) in response to rotation of the throw member 50 relative to the lock cylinder 16. The throw member 50 and its throw pins 18 and the cam 54 cooperate to provide an actuation assembly for operating a lockset (not shown) under the control of the disposable construction core.

Actuator member 12 provides the means for operably engaging the actuation assembly 18, 50, 54 so that a lockset matched with lock cylinder 16 is actuable upon rotation of the actuator member 12 in the lower chamber portion 24. Actuator member 12 includes a longitudinal shaft 56 and a handle 58 affixed to the outside end of the shaft 56. It will be understood that many types of handle means could be employed in lieu of handle 58 to permit a user to rotate shaft 56 in lower chamber portion 24.

Shaft 56 includes an inner end formed to include two longitudinally extending apertures 60 for receiving the pair of throw pins 18. Referring now to FIGS. 1, 5, and 7, shaft 56 includes an annular head 62 at its inner end and a pair of axially spaced-apart annular flanges 64, 66 situated at the periphery of shaft 56 between head 62 and handle 58. The shaft 56 includes a first axially rearwardly facing cam surface 68 on head 62, a second axially rearwardly facing cam surface 70 on flange 64, a third axially rearwardly facing cam surface 72 on flange 66, and a fourth axially rearwardly facing cam surface 74 on a remaining portion of shaft 56 intermediate flange 66 and handle 58. Shaft 56 still further includes an axially forwardly facing ejection surface 76 on head 62, a first axially forwardly facing cam surface 78 on flange 64, and a second axially forwardly facing cam surface 80 on flange 66.

Figure 4:
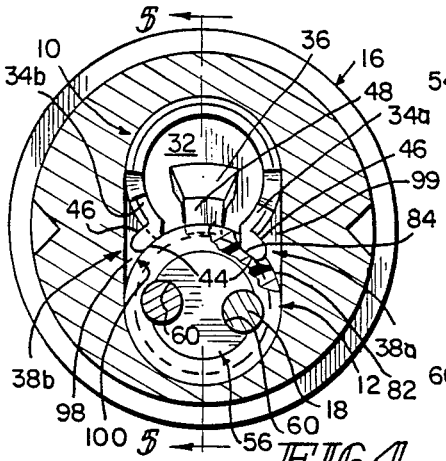
FIG. 4 is a transverse section similar to FIG. 3 illustrating a splayed position of the fingers after insertion of the actuator member into the lower chamber portion of the core-receiving chamber.

Annular flange 64 further includes a first circumferentially extending rim 82 formed to include a first notch 84. Rim 82 supports the pair of fingers 38*a, b* as shown in FIGS. 4 and 5 and first notch 84 is sized and situated to receive one of the fingers 34*a, b* upon rotation of shaft 56 to a predetermined position corresponding to the upright inactive position of cam 54. The resilient fingers 38*a, b* act to apply a predetermined biasing force to rim 82 to inhibit free rotation of shaft 56 in lower chamber portion 24 slightly during operation of the actuator member 12 by a user. This slight, but constant, pressure provides a characteristic tactile feel of the actuator member 12 apparent to the user during manual rotation of the actuator member 12. Annular flange 66 also includes a similar second circumferentially extending rim 86 and second notch 88 which function in the same manner as rim 82 and notch 84 upon insertion of actuator member 12 into an axially deeper core-receiving chamber of a lock cylinder compared to chamber 24 in FIGS. 5 and 7, which cylinder is configured to hold a relatively longer lock core having more tumbler pins.

Shaft 56 is also formed to include an annular finger-receiving groove 90 defined by boundaries provided by ejection surface 76 and first rearward cam surface 70, an annular first tang-receiving groove 92 defined by first forward cam surface 78 and third rearward cam surface 72, and an annular second tang-receiving groove 94 defined by second forward cam surface 80 and fourth rearward cam surface 74. It will be understood that by providing multiple flanges 64, 66 and tang-receiving grooves 92, 94, the disposable construction core of the present invention is adapted to accommodate lock cylinders set up to receive lock cores of varying length having a variety of pin tumblers.

Assembly of the disposable construction core is shown sequentially in FIGS. 1, 3, and 4. The first step is to insert plug member 10 into upper chamber portion 20 and push it rearwardly until closure portion 32 is seated on the peripheral lip 96 near the front opening of core-receiving chamber 14. Top face 46 of each offset finger 38*a, b* slides on second inner wall 26 during insertion of plug member 10. A fully inserted position of plug member 10 is illustrated in FIG. 3 (as seen from a location inside core-receiving chamber 14 looking out through the front opening) showing the orientation of fingers 38*a, b* and center tang 48 relative to lock cylinder 16 prior to installation of actuator member 12.

One should investigage to make sure that cam 54 and throw assembly 18, 50 are aligned in a proper position with respect to lock cylinder 16 as shown in FIGS. 4 and 5 prior to installation of actuator member 12. The actuator member 12 is then oriented for installation by arranging handle 58 so that notches 84, 88 are presented upwardly toward the upper chamber portion 20 and aligning apertures 60 in the end of shaft 56 to accept throw pins 18. As shown in FIG. 1, arrow 98 is formed on handle 58 to designate the foregoing "up" position of notches 84, 88 to remind the service person to arrange handle 58 in its proper orientation prior to installation.

The next step is to insert the distal end shaft 56 into the lower chamber portion 24 while holding handle 58 and push it rearwardly as far as it will go so that throw pins 18 are received in apertures 60. During such insertion of the shaft 56, fingers 38*a, b* will be cammed first by first rearward cam surface 68 and then by at least one of second and third rear cam surfaces 70, 72. Outside prongs 34*a, b* are resilient and will be flexed upwardly during such camming action on shaft 56. To complete installation, one should pull gently on handle 58 to retract actuator member 12 somewhat so that fingers 34*a, b* will seat properly on first rim 82 of annular flange 64 as shown in FIGS. 4 and 5. In this position, rim 82 acts to urge fingers 34*a, b* upwardly toward upper chamber portion 20 so that the front face 40 of at least one of fingers 34*a, b* engages with the rearwardly facing surface 99 of control lug projection 100 as shown in FIGS. 3 and 4. Control lug projection 100 is provided in the core-receiving chamber 14 to engage a control lug (not shown) of a conventional key-removable lock core (not shown) to retain the core in the chamber 14 in the customary way.

Actuator member 12 can now be rotated in a counterclockwise direction (as seen from FIG. 4) to rotate throw member assembly 18, 50 and cam 54 to actuate a lockset (not shown) connected to cam 54. It will be appreciated that, following proper installation of actuator member 12, center tang 48 is seated in first tang-receiving groove 92 to rest between surfaces 78, 72, thereby inhibiting accidental or inadvertent retraction of actuator member 12 from its home in the lower chamber portion 24 during use. Of course, plug member 10, which provides the base of support for center tang 48, is temporarily blocked from retraction by engagement of fingers 34*a, b* against control lug projections 100 as long as rim 82 of shaft 56 acts to splay fingers 38*a, b* outwardly into such blocking engagement. Thus, center tang 48 is fixed substantially in the position illustrated in FIGS. 4 and 5 as long as actuator member 12 remains in its proper position in the lower chamber portion 24.

Finger 38*a* is positioned to snap into notch 84 as shown in FIG. 4 as a detent snaps into a groove to provide a user with a tactile indication that actuator member 12 is in a home position corresponding to the unactuated state of the lockset (not shown) matched with lock cylinder 16. Second annular rim 86, notch 88, and second tang-receiving groove 94 function in the same manner as rim 82, notch 84, and groove 92, respectively, in the case where the cylinder has a core-receiving chamber of greater axial depth sufficient to receive a larger key-removable lock core having more tumbler pins. For example, rim 82, notch 84, and groove 92 could be usable in the foregoing manner in a lock cylinder (such as cylinder 16) designed to house a lock core having six tumbler pins while rim 86, notch 88, and groove 94 would then be properly situated to function in the foregoing manner in a lock cylinder (not shown) designed to house a lock core of longer length having seven tumbler pins.

It will be appreciated that each of fingers 38*a, b* and center tang 48 are biased by their respective prongs 34*a, b* and 36 into engagement with shaft 56 in the locations illustrated in FIGS. 4 and 5 to inhibit rotation of actuator member 12 just enough to provide a desirable characteristic tactile feel of the actuator member 12 to the user during operation of the actuator member 12. However, but for such biased engagement of the plug member 10 on shaft 56, the actuator member 12 would rotate freely in the lower chamber portion 24.

The disposable construction core is easily dissassembled in the following manner as shown in FIGS. 6 and 7. By pulling handle 58 with a smooth constant force in a direction away from cylinder 16, both of the actuator member 12 and the plug member 10 are withdrawn from core-receiving chamber 14 in one swift motion. Fingers 38*a, b* and center tang 48 snap into annular finger-receiving groove 90 as shown best in FIG. 7 to remove any biasing force formerly exerted on rim 82 and groove 92 by the fingers 38*a, b* and center tang 48. In this position, fingers 38*a, b* no longer engage the rearwardly facing surface 99 of control lug projection 100 because they are moved to the position shown in FIGS. 6 and 7 by the resilient character of outside prongs 34*a, b*.

Engagement surface 76 engages the back face 42 of each of fingers 38*a, b* as shown in FIG. 7 during withdrawal of actuator member 12 from lower chamber portion 24. The plug member 10 is automatically ejected from upper chamber portion 20 due to this engagement in response to continued withdrawal of actuator member 12. Advantageously, such an automatic ejection feature makes it unnecessary for a service person to remove plug member 10 in a subsequent step using a special tool.

Although the invention has been described in detail with reference to certain preferred embodiments, variations and modifications exist within the scope and spirit of the invention as described and defined in the following claims.

What is claimed is:

1. A core assembly for use in a lock cylinder formed to include an axially extending core-receiving chamber of figure-8 cross-section providing upper and lower chamber portions and including actuating means extending into the lower chamber portion for actuating a lock assembly, the core assembly comprising a plug member configured to fit in the upper chamber portion, and an actuator member situated in the lower chamber portion to abut the plug member and configured to rotate freely in the lower chamber portion relative to the abutting plug member, the actuator member including means for operably engaging the actuating means so that the lock assembly is actuable upon rotation of the actuator member in the lower chamber portion and ejecting means engaging the plug member for ejecting the plug member from the upper chamber portion in response to withdrawal of the actuator member from the lower chamber portion.

2. A core assembly for use in a lock cylinder formed to include an axially extending core-receiving chamber of figure-8 cross-section providing upper and lower chamber portions and including means extending into the lower chamber portion for actuating a lock assembly, the core assembly comprising a plug member configured to fit in the upper chamber portion, and an actuator member configured to rotate freely in the lower chamber portion, the actuator member including means for operably engaging the actuating means so that the lock assembly is actuable upon rotation of the actuator member in the lower chamber portion and means for ejecting the plug member from the upper chamber portion is response to withdrawal of the actuator member from the lower chamber portion, the plug member including at least one finger configured to extend into the lower chamber portion while the plug member is positioned in the upper chamber portion, the ejecting means including means for contacting the at least one finger during withdrawal of the actuator member from the lower chamber portion.

3. The core assembly of claim 2, wherein each finger includes an axially rearwardly presented face and the contacting means includes an axially forwardly presented face aligned in confronting relation to the axially rearwardly presented face to intercept the axially rearwardly presented face and apply a movement-inducing force to the plug member during withdrawal of the actuator member from the lower chamber portion.

4. The core assembly of claim 2, wherein the lock cylinder includes an inner wall defining the upper chamber portion, and the plug member includes a body portion configured to mate with the inner wall and means for resiliently supporting each finger for flexible movement relative to the body portion in a predetermined position biased against the actuator member so that the supporting means and each finger cooperate to apply radially inwardly directed force of a predetermined magnitude to the actuator member to inhibit free rotation of the actuator member relative to the lock cylinder during operation of the actuating means by a user, thereby providing a characteristic tactile feel of the actuator member apparent to the user during manual rotation of the actuator member.

5. The core assembly of claim 4, wherein the actuator member includes an elongated shaft having the engaging means at one of its ends, handle means for applying a rotation-inducing torque to the shaft about its longitudinal axis at the other of its ends, and rim means for supporting each finger in its biased position, the rim means is situated on the elongated shaft intermediate the engaging means and the handle means, the rim means and the engaging means cooperate to define groove means for receiving each finger upon movement of the shaft to a predetermined position in the lower chamber portion during withdrawal of the actuator member so that the radially inwardly directed force normally applied by each finger to the actuator member is substantially eliminated to permit free rotation of the actuator member relative to the lock cylinder, and the engaging means includes an axially forwardly presented face arranged to define an axially rearward boundary of the groove means and to intercept the finger and apply a movement-inducing force to the plug member during withdrawal of the actuation member from the lower chamber portion.

6. A core assembly for use in a lock cylinder formed to include an axially extending core-receiving chamber of figure-8 cross-section providing upper and lower chamber portions and including actuating means extending into the lower chamber portion for actuating a lock assembly, the core assembly comprising an actuator member configured to rotate freely in the lower chamber portion, the actuator member including means for operably engaging the actuating means so that the lock assembly is actuable upon rotation of the actuator member in the lower chamber portion, and engaging means separate from the lock cylinder for frictionally engaging the rotatable actuator member to retain the actuator member substantially in a predetermined axial position in the lower chamber portion upon communication of the actuator member and the engaging means, the engaging means being mounted in the upper chamber portion to extend in the lower chamber portion for yieldably blocking the actuator member against axial movement in the lower chamber portion.

7. A core assembly for use in a lock cylinder formed to include an axially extending core-receiving chamber of figure-8 cross-section providing upper and lower chamber portions and including means extending into the lower chamber portion for actuating a lock assembly, the core assembly comprising an actuator member configured to rotate freely in the lower chamber portion, the actuator member including means for operably engaging the actuating means so that the lock assembly is actuable upon rotation of the actuator member in the lower chamber portion, and means separate from the lock cylinder for retaining the actuator member substantially in a predetermined axial position in the lower chamber portion upon communication of the actuator member and the engaging means, the actuator member including an axially forwardly presented cam surface, the retaining means including a plug member configured to fit in the upper chamber portion, the plug member including means for yieldably abutting the cam surface to limit axially outward movement of the actuator member during withdrawal of the actuator member from the lower chamber portion as long as the withdrawal-inducing force applied to the actuator member remains less than a predetermined maximum magnitude.

8. The core assembly of claim 7, wherein the lock cylinder includes an inner wall defining the upper chamber portion, the plug member further includes a body portion configured to mate with the inner wall, and a closure portion attached to the body portion to cover a forwardmost opening of the upper chamber portion, and the abutting means includes a resilient first prong having a proximal end affixed to the closure portion, an axially rearwardly extending distal end, and a radially inwardly extending tang appended to the distal end of the resilient first prong to lie in position at about a common boundary between the upper and lower chamber portions to engage the axially forwardly presented cam surface of the actuator member during withdrawal of the actuator member.

9. The core assembly of claim 8, wherein the lock cylinder includes an axially rearwardly presented blocking surface situated at the common boundary, and the plug member further includes finger means extending into the lower chamber portion for selectively engaging said axially rearwardly presented blocking surface to limit axially outward movement of the plug member and its tang relative to the lock cylinder.

10. The core assembly of claim 9, wherein the lock cylinder includes projection means for engaging a movable control lug of a key-removable lock core assembly insertable into the core-receiving chamber and the projection means includes the axially rearwardly presented blocking surface.

11. The core assembly of claim 8, wherein the plug member further includes at least one resilient second prong having a proximal end affixed to the closure portion and an axially rearwardly extending distal end, and a radially inwardly extending finger appended to the distal end and configured to extend into the lower chamber portion while the plug member is positioned in the upper chamber portion, the lock cylinder includes an axially rearwardly presented blocking surface situated at the common boundary, and the actuator member includes an elongated shaft having the engaging means at one of its ends, handle means for applying a rotation-inducing torque to the shaft about its longitudinal axis at the other of its ends, and rim means for urging each finger toward the upper chamber portion so that an axially forwardly presented surface of each finger is positioned to confront the blocking surface of the lock cylinder in engageable relation to limit axially outward movement of the plug member and its tang relative to the lock cylinder upon engagement of each finger and the blocking surface.

12. The core assembly of claim 11, wherein the lock cylinder includes projection means for engaging a movable control lug of a key-removable lock core assembly insertable into the core-receiving chamber and the projection means includes the axially rearwardly presented blocking surface.

13. A core assembly for use in a lock cylinder formed to include an axially extending core-receiving chamber of figure-8 cross-section providing upper and lower chamber portions and including means extending into the lower chamber portion for actuating a lock assembly, the core assembly comprising an actuator member configured to rotate freely in the lower chamber portion, the actuator member including means for operably engaging the actuating means so that the lock assembly is actuable upon rotation of the actuator member in the lower chamber portion, and a plug member configured to fit in the upper chamber portion, the plug member including means for applying biasing force against the actuator member of a predetermined magnitude to inhibit free rotation of the actuator member relative to the lock cylinder during operation of the actuation means by a user, thereby providing a characteristic tactile feel of the actuator member apparent to the user during manual rotation of the actuator member.

14. The core assembly of claim 13, wherein the lock cylinder includes an inner wall defining the upper chamber portion, the plug member includes a body portion configured to mate with the inner wall, the applying means includes at least one finger configured to extend into the lower chamber portion while the plug member is positioned in the upper chamber portion, and means for resiliently supporting each finger for flexible movement relative to the body portion in a predetermined position biased against the actuator member.

15. The core assembly of claim 14, wherein the actuator member includes an elongated shaft having the engaging means at one of its ends, handle means for applying a rotation-inducing torque to the shaft about its longitudinal axis at the other of its ends, and rim means for supporting each finger in its biased position, the rim means is situated on the elongated shaft intermediate the engaging means and the handle means, the rim means and the engaging means cooperate to define groove means for receiving each finger upon movement of the shaft to a predetermined position in the lower chamber portion during withdrawal of the actuator member so that the radially inwardly directed force normally applied by each finger to the actuator member is substantially eliminated to permit free rotation of the actuator member relative to the lock cylinder, and the engaging means includes an axially forwardly presented face arranged to define an axially rearward boundary of the groove means and to intercept the finger and apply a movement-inducing force to the plug member during withdrawal of the actuation member from the lower chamber portion.

16. The core assembly of claim 15, wherein the engaging means includes an actuation cam situated outside of the lock cylinder and the rim means is formed to include notch means for receiving one finger in its biased position during rotation of the actuator member to align the actuation cam and the actuator member in a predetermined arrangement to provide an indication of the relative orientation of the actuation cam and the lock cylinder based upon the aligned position of the actuator member.

17. A core assembly for use in a lock cylinder formed to include an axially extending core-receiving chamber of figure-8 cross-section providing upper and lower chamber portions and an axially rearwardly facing surface communicating with the lower chamber, the core assembly comprising a plug member configured to fit in the upper chamber portion, the plug member including a pair of spaced-apart resilient fingers extending into the lower chamber portion upon positioning of the plug member in the upper chamber portion, and an actuator member configured to rotate freely in the lower chamber portion, the actuator member including means for splaying the pair of resilient fingers upon positioning of the actuator member in a predetermined position within the lower chamber portion so that at least one of the resilient fingers is moved to assume a position in confronting engageable relation to the axially rearwardly facing surface, thereby blocking withdrawal of the plug member from the upper chamber portion.

* * * * *